United States Patent [19]

Asick et al.

[11] Patent Number: 4,693,528

[45] Date of Patent: Sep. 15, 1987

[54] SURFACE MOUNT CONNECTOR WITH FLOATING TERMINALS

[75] Inventors: John C. Asick, Harrisburg; George H. Douty, Mifflintown; James S. Staron, Millersburg, all of Pa.

[73] Assignee: AMP Incorporated, Harrisburg, Pa.

[21] Appl. No.: 873,138

[22] Filed: Jun. 6, 1986

Related U.S. Application Data

[63] Continuation of Ser. No. 740,111, May 31, 1985, abandoned.

[51] Int. Cl.[4] ..... H01R 9/09

[52] U.S. Cl. ..... 439/83; 29/843; 439/571; 439/873

[58] Field of Search ..... 339/17 R, 17 C, 17 CF, 339/17 D, 17 L, 17 LM, 17 M, 125 R, 217 S, 275 B; 29/843, 844

[56] References Cited

U.S. PATENT DOCUMENTS

| | | | |
|---|---|---|---|
| 3,960,423 | 6/1976 | Weisenburger | 339/17 CF |
| 4,220,383 | 9/1980 | Scheingold et al. | 339/17 CF |
| 4,222,622 | 9/1980 | Griffin et al. | 339/17 CF |
| 4,516,188 | 5/1985 | Kessler | 339/17 M |

*Primary Examiner*—Neil Abrams

*Attorney, Agent, or Firm*—F. Brice Faller; Adrian J. LaRue; David L. Smith

[57] ABSTRACT

Surface mount connector has terminals which float axially in passages through housing. Each terminal is spring loaded toward mounting face to provide compliance between solder tails and pads on printed circuit board. Metal clips have legs received in holes through board which anchor connector independently of solder tails.

12 Claims, 9 Drawing Figures

SURFACE MOUNT CONNECTOR WITH FLOATING TERMINALS

This application is a continuation of application Ser. No. 740,111 filed May 31, 1985 and now abandoned.

BACKGROUND OF THE INVENTION

The present invention relates to a connector having terminals therein with solder tails formed for mounting against the surface of a printed circuit board.

Connectors having terminals with solder tails extending therefrom for reception in plated through holes of a printed circuit board are well known. Recently, in the interests of facilitating automated placement and economy of circuit board manufacture, "surface mount" connectors have been developed. Such connectors have terminals with solder tails formed for disposition against plated pads on the surface of the board. The terminals are typically fixed in the connector housing, and the tails are formed to sufficient length to assure compliance with the pads regardless of board warpage. In order to achieve the desired properties of a low normal force at the contact interface and a large range of deflection, this entails having solder tails which extend beyond the sidewalls of an elongate housing, which subjects them to damage during handling. If the solder tails were to extend toward adjacent terminals in a row rather than adjacent sidewalls, terminal spacing would have to be increased, and further the "footprint" of the connector would not axially correspond with the respective mating ends of terminals therein.

SUMMARY OF THE INVENTION

According to the invention, a surface mount connector with floating terminals is provided. The solder tail is of limited resilience, lying substantially in line with the respective terminal-receiving passage at the mating face of the connector. The tails may be of short length formed as lap joints at right angles to the axis of the terminal, so that a flat rolled surface of the metal stock contacts the pads, as butt joints, so that sheared surfaces contact the pads, or as a "J", presenting an arcuate rolled surface to each pad. Compliance is provided by a spring finger formed across the axis of the terminal, which finger bears against a shoulder which faces the mounting face of the connector. This loads the solder tail away from the shoulder and against the circuit board to which the connector is mounted. The fingers may be coined during manufacture so as to be thinner than the stock of the terminal as a whole, yielding a light spring action and low normal force at the contact interface while providing a large range of deflection. Spring loading the contact is necessary to compensate for irregularities in printed circuit board shape, such as bowing and warpage, and further to insure a reliable solder joint. The design also protects the solder tails and permits a high density terminal spacing with a compact "footprint" which conserves circuit board real estate.

According to another aspect of the invention, a surface mount connector is held to the circuit board prior to soldering by metal clips at opposite ends of the housing. The clips have legs received in holes in the circuit board in an interference fit, anchoring the connector during the reflow solder process which joins the solder tails as well as the clips to the pads. Metal clips offer an advantage over plastic legs molded integrally with the housing, insofar as plastic legs deform plastically during reflow heating. The deformation decreases their retention force and subjects the solder joints to stress if the connector is rocked during mating or unmating of a complementary connector. Metal clips in an interference fit, on the other hand, do not lose their retaining force when subjected to heat and thus resist strain when soldering is completed. Alternatively, the legs may be received through the holes loosely and bent over in the fashion of staples to retain the connector.

DETAILED DESCRIPTION OF THE PREFERRED EMBODIMENT

Figure 1:
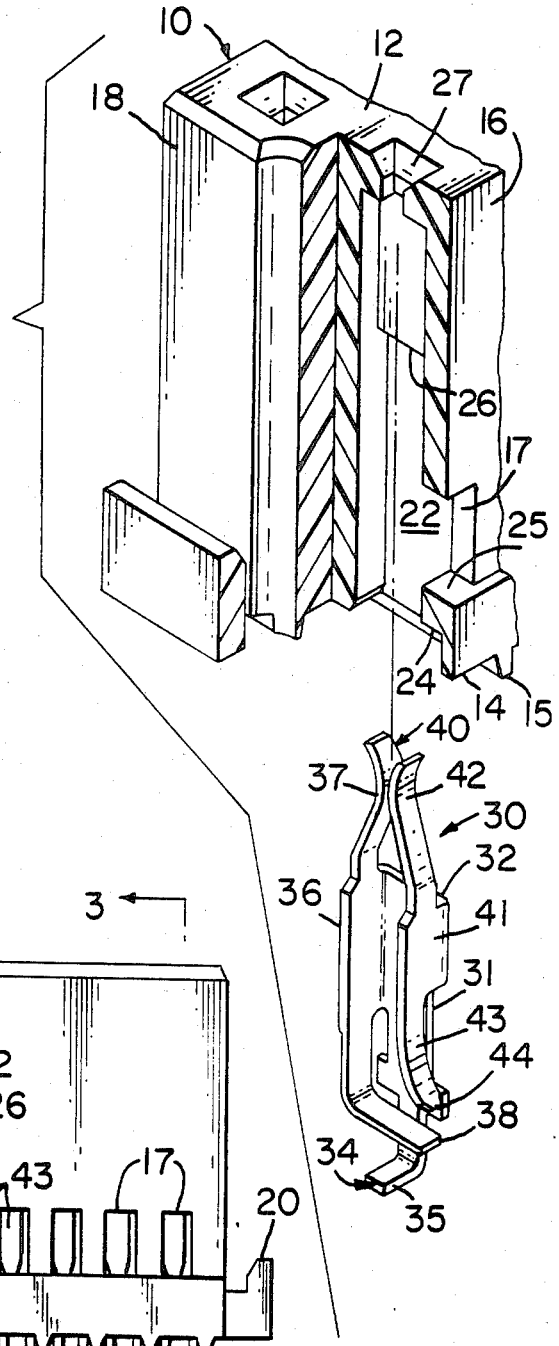
FIG. 1 is a perspective of a receptacle terminal with a lap joint shoulder tail exploded from a cutaway housing.

FIG. 1 depicts a molded plastic connector housing 10 with a receptacle terminal 30 exploded therefrom. The housing 10 has a mating face 12 which receives a complementary post connector and an opposed mounting face 14 having standoff ribs 15 which are received against a printed circuit board. The housing 10 is further defined by opposed external sidewalls 16 and opposed external endwalls 18 extending between faces 12, 14. Terminal receiving passages 22 extend between faces 12, 14 and communicate with the adjacent sidewall 16 via a window 17. Each passage 22 has a first shoulder 24 proximate to and facing the mounting face 14, a second shoulder 25 defined by window 17 and facing the mating face 12, a third shoulder 26 toward the mating face 12 and facing the mounting face 14, and a closed entry 27 at mating face 12.

A receptacle terminal 30 is stamped and formed from metal strip stock, and like all such terminals has major roller surfaces bounded by sheared edge surfaces. The terminal 30 comprises a web 31 flanked by parallel side portions 36, 41 formed normally thereto. A mating end 40 is defined by arms 37, 42 which extend freely from respective side portions 36, 41. Side portion 36 has a first spring finger 38 extending therefrom opposite arm 37 and formed to extend across the axis of the terminal. Side portion 41 has a second spring finger on lance 43 extending freely therefrom opposite arm 42 and diverging from the axis of the terminal toward distal end 44. The web 31 is bounded by a top edge 32 toward mating end 40 and an opposed solder tail 35 which defines mounting end 34. The solder tail 35 is formed as a lap joint so as to present a rolled surface to the circuit board when mounted, although a butt joint presenting a sheared edge surface is envisioned as an alternative.

Figure 2:
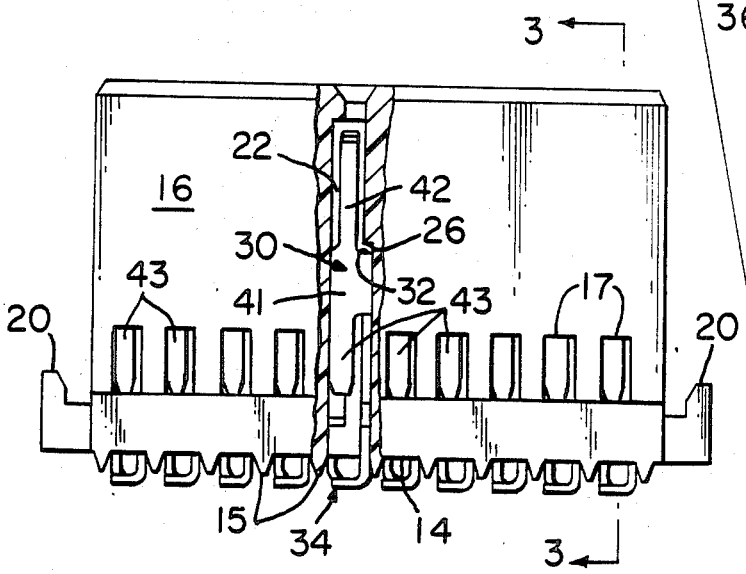
FIG. 2 is a partially sectioned side view of a receptacle connector.

FIG. 2 is a side view of the assembled connector with part of a sidewall 16 cut away to expose a terminal 30 seated in passage 22. Side portion 41 with mating arm 42 and lance 43 faces the viewer. The mounting end 34 is loaded to extend beyond standoffs 15 on mounting face 14, and top edge 32 is spaced from third shoulder 26 in the housing.

Figure 3A:
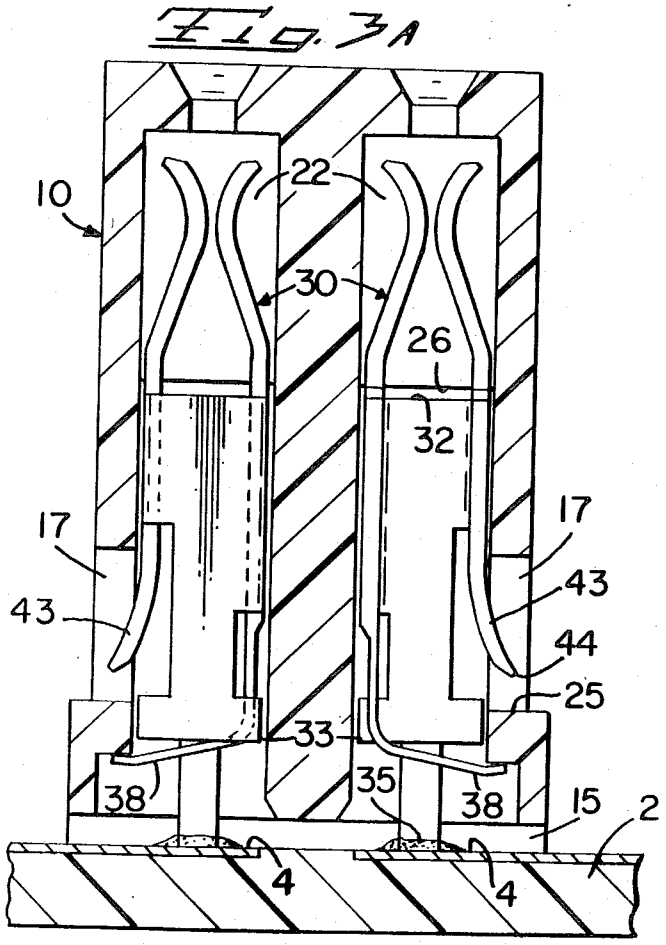
FIG. 3A is an end section of the receptacle connector as mounted.
Figure 3:
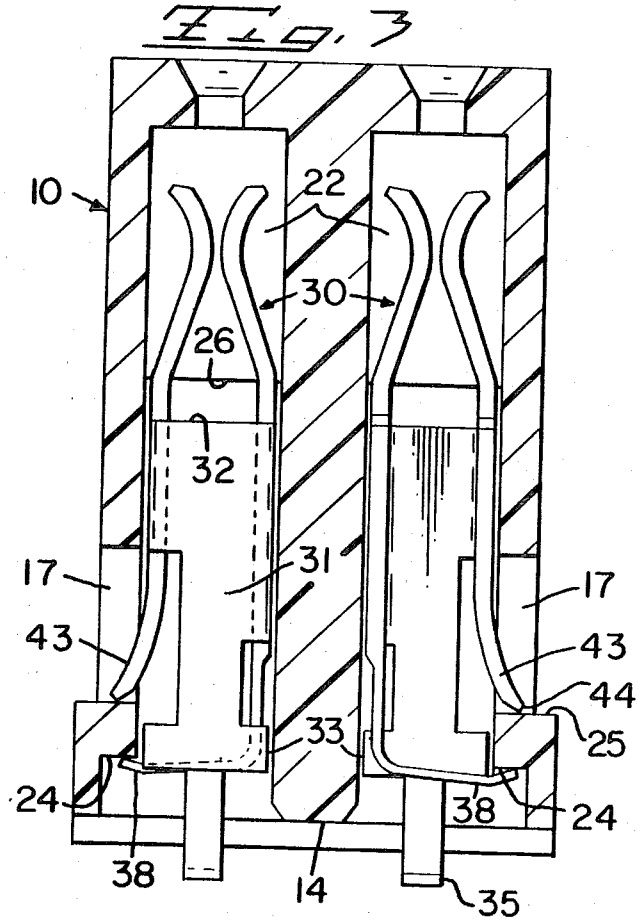
FIG. 3 is an end section taken along line 3—3 of FIG. 2.

Referring to FIG. 3, terminals 30 are received in respective passages 22 from mounting face 14, the lances 43 resiling inward until they reach windows 17, whence they return so that distal ends 44 rest on second shoulders 25. The ends of first spring fingers 38 are lodged against respective first shoulders 24 to axially position each terminal, while ears 33 on web 31 assist in lateral positioning.

FIG. 3A is a view similar to FIG. 3, after the connector is mounted to circuit board 2. Each terminal 30 is urged into respective passage 22 until the standoffs 15 are against the board 2, the spring fingers 38 loading the solder tails 35 against respective pads 4 on the circuit board. The stock thickness of the strip from which terminal 30 is stamped is 8 mils, but the spring finger 38 is coined to a thickness of 6 mils prior to the forming operations. This yields spring properties for the desired low normal force and large range of compliance at the contact interface. The stock thickness may, of course, vary in accordance with design requirements, and the spring finger may likewise not be of reduced thickness. Note there is still some clearance between edge 32 and third shoulder 26, this serving only to limit over travel during handling, which could deform the spring finger 38.

Figure 4:
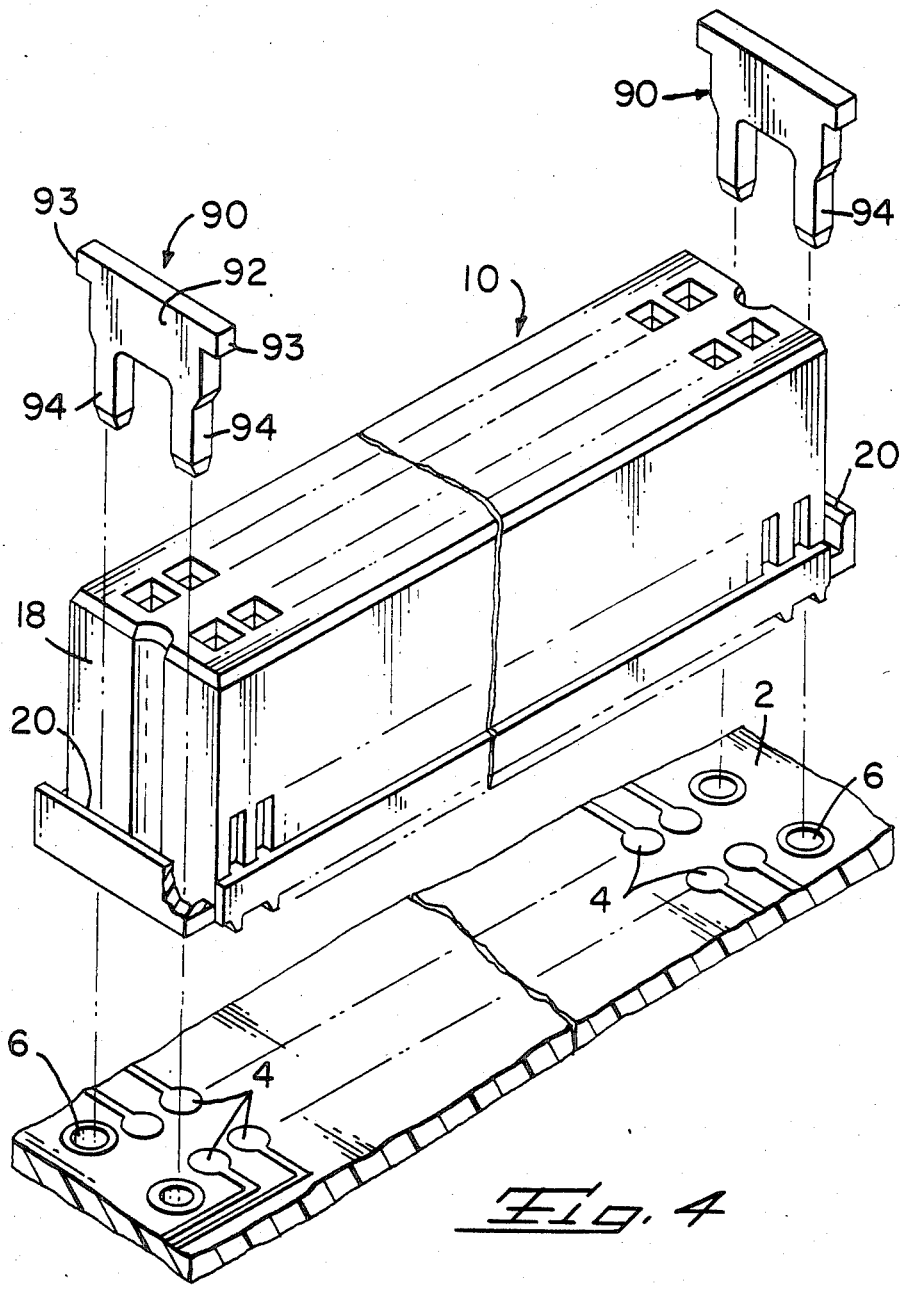
FIG. 4 is a perspective of the receptacle connector poised for mounting.

FIG. 4 shows receptacle connector poised for mounting to circuit board 2. A clip 90 is received in a cradle 20 on each endwall 18; each clip 90 has a body portion 92 and legs 94 received in holes 6 through board 2 in an interference fit. This positions the connector relative to the board during the vapor phase soldering operation, which bonds both the solder tails 35 and the clips 90 to the board.

Figure 5:
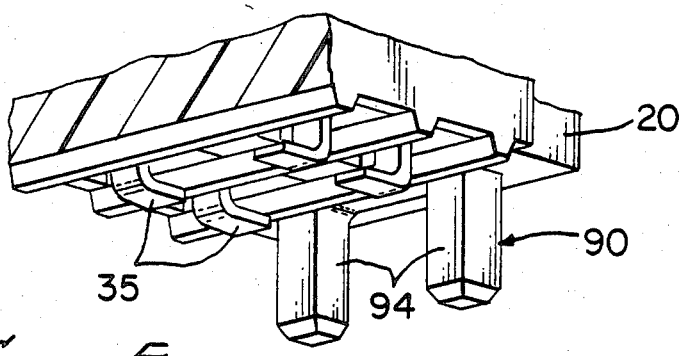
FIG. 5 is a partial perspective of the mounting face.

FIG. 5 shows the alignment of lap joint solder tails 35 in the parallel rows; the tails in each row have a like alignment, which for identical terminals, is 180 degrees from the tails 35 on the adjacent row. The clip 90 is stamped from 25 mil stock so that legs 94, shown extending through slot 21 in the cradle 20 are of square profile.

Figure 6:
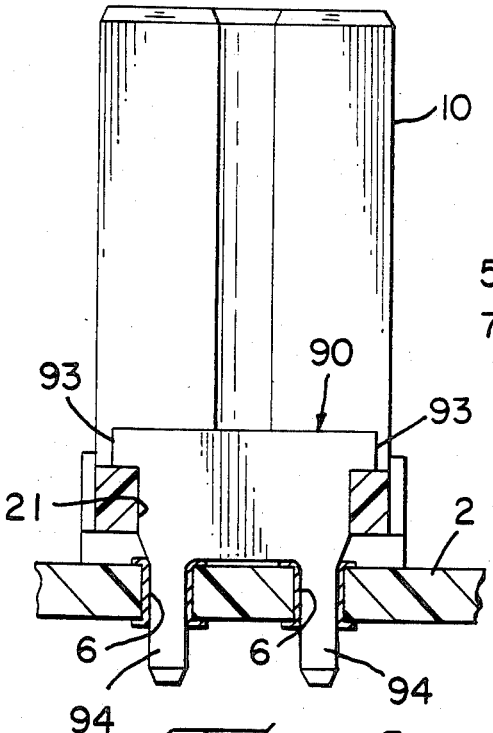
FIG. 6 is an end section of the receptacle connector as mounted.

FIG. 6 shows how ears 93 bear on cradle 20 adjacent the slot to retain the connector against the board 2. During assembly, tooling need only bear against the tops of clips 90 at opposite ends of the housing 10, thus facilitating robotic assembly.

Figure 7:
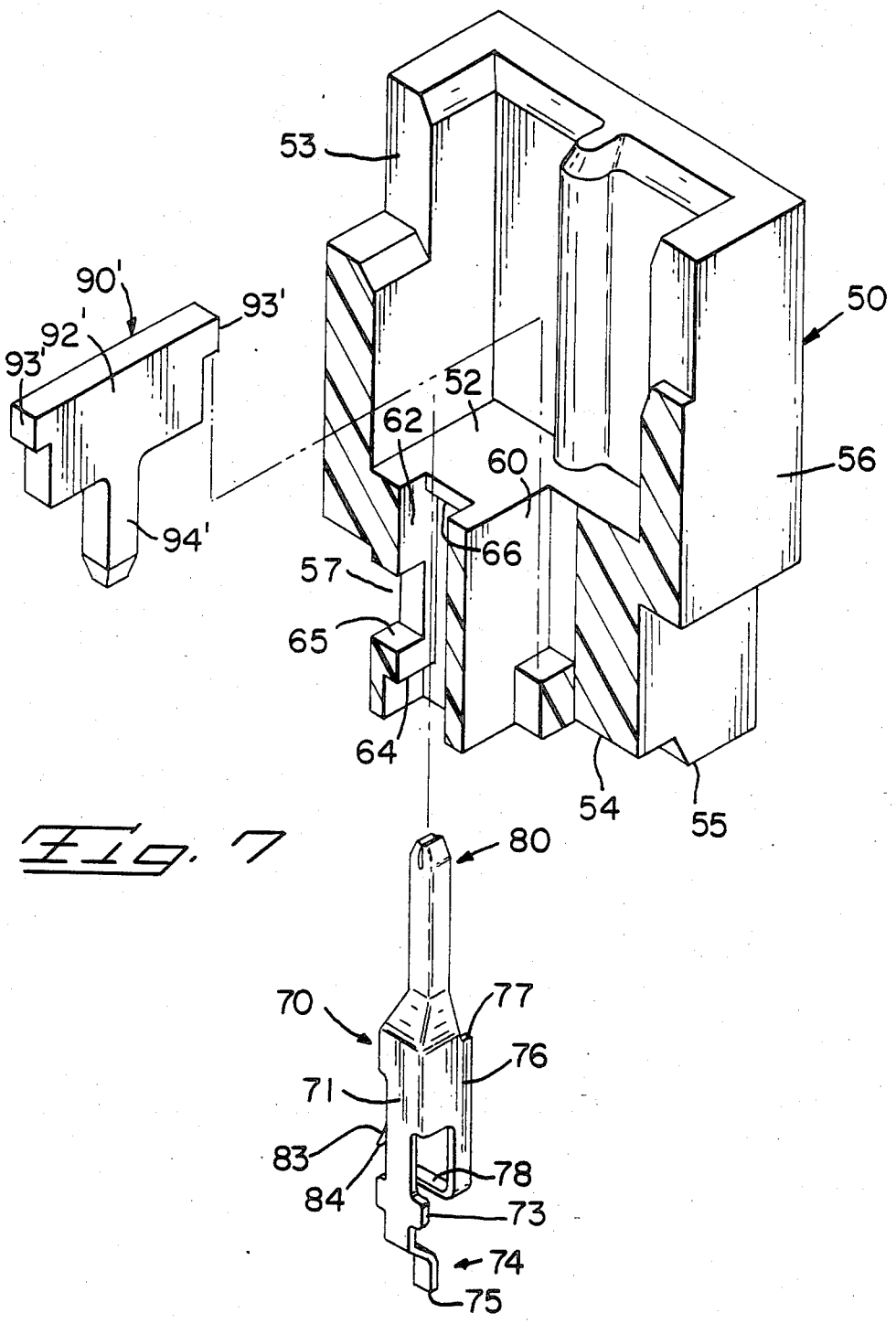
FIG. 7 is a perspective of a post terminal with a butt joint solder tail exploded from a cutaway shrouded housing.

FIG. 7 shows an alternative embodiment according to the invention, a shrouded post header which is complementary to the receptacle connector described in conjunction with FIGS. 1 to 6. The post housing 50 has a mating face 52 surrounded by a shroud 53, and an opposed mating face 54 interrupted by standoff ribs 55. Sidewalls 56 have windows 57, but board retention is provided by clips received in cradles 60 molded in the mating face 52. Terminal passages 62 extend between faces 52, 54, each passage having a first shoulder 64 facing the mounting face 54, a second shoulder 65 defined by respective window 57, and a third shoulder 66 proximate mating face 52. As with third shoulder 26 in the receptcle housing 10, shoulder 66 serves to limit axial float of terminal 70.

Post terminals 70 are stamped and formed from 6 mil thick stock, each having a web 71 flanked by side portions 76, 81 formed normally thereof, which portions are formed together toward mating end 80 as a post about 16 mils square. Slide portion 76 has a first spring finger 78 extending freely therefrom and formed across the axis of the terminal, while side portion 81 (FIG. 8) has a second spring finger or lance 83 which diverges from the axis of the terminal toward distal end 84. Side portions 76, 81 are stamped with corners 77, 82 toward mating end 80 to limit axial float against shoulder 66, while ears 73 limit lateral float. The mounting end 74 is formed with a butt joint solder tail 75, so that a sheared surfce bears against a contact pad. Note that a solder tail of this type may be provided on terminals 30 in the receptacle connector, and likewise the lap joint solder tails 35 could be formed on the post terminals 70. Clip 90', received in centrally located cradles 60, has a body portion 92', ears 93', and but one leg 94'. This is a simple alternative to clip 90 (FIG. 4) and serves a similar function.

Figure 8:
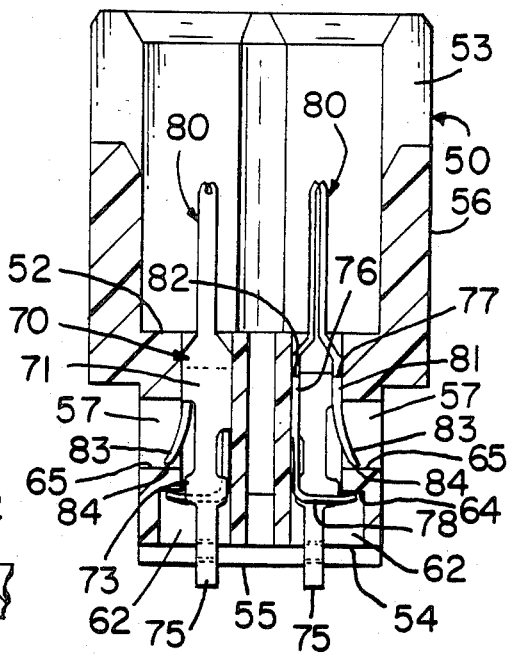
FIG. 8 is an end section of a shrouded post connector.

FIG. 8 is a cross section similar to that of FIG. 3, and serves to illustrate that the floating terminal principle is the same for either embodiment. The spring finger 78 urges the solder tail 75 away from mounting face 54, and serves to load it against a respective solder pad during the reflow operation. Standoff ribs 55, like ribs 15 (FIGS. 1, 2, 3) serve to keep the housing clear of the solder.

The foregoing is exemplary and not intended to limit the scope of the claims which follow.

We claim:

1. An electrical connector of the type for mounting onto a circuit board for electrical connection with conductive areas thereof comprising a dielectric housing having terminal-receiving passages extending therethrough and including retaining shoulders therein, electrical terminals respectively positioned within the terminal-receiving passages and having contact sections and conductor-engaging sections, and retaining members on the terminals for engagement with the retaining shoulders thereby retaining the terminals in position in the terminal-receiving passages, characterized in that said terminals are axially moveable along said passages between limiting positions defined by engagement of a pair of retaining members with respective retaining shoulders and one of said retaining members springably engages one of the retaining shoulders when the connector is mounted on the circuit board thereby urging and maintaining the conductor-engaging sections in electrical engagement with respective conductive areas on the circuit board.

2. An electrical connector as in claim 1 characterized in that said housing is elongate, having opposed parallel sidewalls along its length, and opposed parallel endwalls across its width, said passages and respective terminals lying in at least one row therein, each said conductor-engaging section being formed to extend toward an adjacent terminal in the row.

3. An electrical connector as in claim 2 characterized in that said one of said retaiing members extends toward an adjacent sidewall.

4. An electrical connector as claimed in claim 1, characterized in that said retaining members extend across the axis of said terminals.

5. An electrical connector as claimed in claim 1, characterized in that said terminals comprise a web portion with first and second side wall portions extending normally thereof, said retaining member being formed from the first side wall portion.

6. An electrical connector as claimed in claim 1, characterized in that said conductor-engaging sections extend across the axis of the terminals, 7. An electrical connector as claimed in claim 5, characterized in that said conductor-engaging sections are formed from said web portions and extend across the axis of said terminals.

8. An electrical connector as claimed in claim 1, characterized in that said retaining members are of reduced thickness relative to the thickness of the remainder of the terminals.

9. An electrical connector for mounting onto a circuit board for electrical connection with conductive areas thereof, comprising:

dielectric housing means having terminal-receiving passages extending therethrough and including retaining shoulders therein;

electrical terminals respectively positioned within the terminal-receiving passages and having contact sections and conductor-engaging sections; and retaining members on the electrical terminals for engagement with the retaining shoulders, said electrical terminals are axially moveable along the terminal-receiving passages between limiting positions defined by engagement of a pair of retaining members with respective retaining shoulders, one of the retaining members springably engaging one of the retaining shoulders when the connector is mounted on the circuit board thereby urging and maintaining the conductor-engaging sections in electrical engagement with respective conductive areas on the circuit board.

10. An electrical connector as claimed in claim 9, wherein said one of said retaining members extend across the axis of said electrical terminals.

11. An electrical connector as claimed in claim 9, wherein said conductor-engaging sections extend across the axis of the terminals.

12. An electrical connector as claimed in claim 9, wherein said one of said retaining members is of reduced thickness relative to the thickness of the rest of the terminals.

* * * * *